United States Patent [19]

Simons et al.

[11] 4,031,692

[45] June 28, 1977

[54] NOVEL HOSIERY YARN

[75] Inventors: F. Holmes Simons; Michael P. Taylor, both of Charlotte, N.C.

[73] Assignee: Fiber Industries, Inc., Charlotte, N.C.

[22] Filed: Jan. 7, 1976

[21] Appl. No.: 647,235

Related U.S. Application Data

[63] Continuation of Ser. No. 275,390, July 26, 1972, abandoned, and a continuation-in-part of Ser. No. 166,580, July 27, 1971, abandoned.

[52] U.S. Cl. ..... 57/140 R; 57/157 TS

[51] Int. Cl.[2] ..... D02G 3/24; D02G 3/26; D02G 1/02

[58] Field of Search ..... 57/140 R, 140 J, 157 S, 57/157 TS, 34 HS

[56] References Cited

UNITED STATES PATENTS

| | | | |
|---|---|---|---|
| 3,279,164 | 10/1966 | Breen et al. | 57/157 TS |
| 3,404,525 | 10/1968 | Tompkins | 57/140 R |
| 3,435,603 | 4/1969 | Rice | 57/34 HS |
| 3,474,612 | 10/1969 | Jenkins et al. | 57/34 HS |
| 3,488,940 | 1/1970 | Mehta | 57/157 TS |
| 3,535,866 | 10/1970 | Tsuruta et al. | 57/34 HS |
| 3,608,299 | 9/1971 | Dugas | 57/157 TS |
| 3,646,747 | 3/1972 | Strohmaier | 57/157 TS |
| 3,670,489 | 6/1972 | Jackson, Jr. et al. | 57/140 R |

*Primary Examiner*—John Petrakes
*Attorney, Agent, or Firm*—Roderick B. Macleod

[57] ABSTRACT

Poly(tetramethylene terephthalate) hosiery yarn.

11 Claims, No Drawings

NOVEL HOSIERY YARN

This is a continuation of abandoned application Ser. No. 275,390, filed July 26, 1972 as a continuation-in-part of application Ser. No. 166,580, filed July 27, 1971, and also abandoned.

Today nylon yarns dominate, practically to the exclusion of other yarn types, the commercial hosiery yarn market. However, as with the case of nearly all endeavors, investigative work is undertaken to discover improved products.

In attempts to develop improved hosiery yarns, polyester [meaning at this stage poly (ethylene terephthalate)] yarn was investigated. It was soon learned that characteristics of twist lively textured poly (ethylene terephthalate) yarn did not lead to a hosiery yarn or hosiery product even equivalent to the available nylon product. To focus on the major shortcomings of the poly (ethylene terephthalate) hosiery yarn, one can conveniently consider for comparative purposes false twist textured hosiery denier poly (ethylene terephthalate) yarn and false twist textured nylon hosiery denier yarn in the same hose leg constructions. Poly (ethylene terephthalate) hosiery, by testing techniques involving the application of stretch (expansion)-relax sequences simulating the naturally-occurring flexing, bend-straighten movements of a human leg, are found to have two prime disadvantages. First, the poly (ethylene terephthalate) hose, following repeated extend-relax cycles, retains only a fraction (about up to two-thirds) of the recovery force retention of nylon hose. The result is poor retention of shape definition around the knee and ankle areas, usually referred to as "bagging". Second, the abrasion resistance of the poly (ethylene terephthalate) hose, particularly around the heel portion during wear trials, is not nearly as good as exhibited by nylon. Through a variety of techniques, most of which will not be discussed herein, it is believed that the abrasion resistance problem of polyester hosiery yarn can be overcome to the point of approaching or equaling that of nylon yarn. Abrasion resistance is not considered hereafter in this specification.

In view of the above background of the invention, it has been discovered that twist-lively hosiery yarn of a particular fiber-formable polyester can be used to produce polyester hose having improved aesthetic properties, particularly during use, than many types, if not all, nylon hose, particularly with respect to shape definition after repeated flexing. Moreover, yarn of the particular polyester is far superior in hosiery applications than poly (ethylene terephthalate) yarn with regard to the above-described shape retention and is apparently at least equivalent thereto in other respects.

This, the present invention relates to a novel twist-lively textured hosiery yarn and hosiery comprised thereof. More particularly, the present invention relates to a twist-lively, textured hosiery yarn comprising at least about 50% by weight of a fiber-formable polyester, said polyester regardless of amount present (50 to 100% of the total polymer employed by weight) consisting essentially of 100% poly (tetramethylene terephthalate). In the preferred and most usual contemplated embodiments of the invention, the hosiery yarn will be formed of essentially 100% poly (tetramethylene terephthalate), it of course being understood that small quantities of physically and/or chemically included additives such as viscosity stabilizers, dye modifiers and the like may be present.

The twist-lively, textured hosiery yarn of the present invention can be produced by the use of texturing processes well known to those skilled in the art. The texturing process will be one in which the yarn is heated, continuously or discontinuously, while in a twisted configuration. For purposes of this patent specification, the "duotwist" process wherein two or more yarns are continuously heated in the run while being wrapped around each other is contemplated within the above "texturing process description". Most often, the twist-lively yarn will be produced by a false twist-heat process. The final hosiery yarn product will have only about a producer level of twist remaining therein.

In one or more preferred embodiments of the invention, the yarn will be characterized by one or more of an initial modulus of from about 25 to about 40 grams per denier, an available torque ratio of from about 1 to about 6, an elastic recovery of at least about 90 percent, a percent developed crimp of at least about 12 percent, and a total denier of from about 10 to about 70.

Poly (tetramethylene terephthalate) may be prepared by procedures well known to the art; thus, e.g., it may be made by the procedure described in U.S. Pat. No. 2,465,319. The relative viscosity of the poly (tetramethylene terephthalate) used in the yarn of this invention should be from about 11 to about 75, although it is preferred that it be from about 18 to about 45; in the most preferred embodiment the relative viscosity of said poly(tetramethylene terephthalate) is from about 22 to about 36. "Relative viscosity" is a measure of the degree of polymerization of the polymer and is the ratio of the viscosity of an eight percent solution (8 grams of polymer dissolved in 100 milliliters of freshly distilled ortho-chlorophenol) to the viscosity of freshly distilled ortho-chlorophenol per se, measured in the same units at 25° centigrade.

It is preferred that the textured hosiery yarn of this invention be comprised of at least 75 percent (by weight of yarn) of poly (tetramethylene terephthalate), and it is most preferred that at least 90 weight percent of said yarn be comprised of poly (tetramethylene terephthalate). The other component(s) of said yarn (if any) may, e.g., be melt-blended with the poly (tetramethylene terephthalate). Thus during the preparation of the poly (tetramethylene terephthalate) other glycol(s) and/or other dicarboxylic acid(s) may be added. Examples of suitable glycols are hydroquinone; cis and trans--cyclohexanedimethanol; 1,1-bis-(hydroxymethyl)-cyclohexane; 2,2,3,3-tetramethyl-1,3-cyclobutanediol; 1,4-cyclohexanediol; ethylene glycol; 1,5-pentanediol; 1,12-dodecanediol; diethylene glycol; triethylene glycol; 2,3-dimethylpropanediol-1,2;2,2,3,3,4,4-hexafluoropentanediol-1,5; decahydro-1,2-bis-(hydroxymethyl) naphthalene; 4,4'-dihydroxybiphenyl; 4,4'-dimethanolhexahydrobiphenyl; bis-(4-hydroxyphenyl) methane; bis-(4-hydroxyphenyl) ether; bis-(4-hydroxyphenyl) sulfone; bis-(4-hydroxyphenyl) ketone; bis-(4-hydroxyphenyl) sulfoxide; 2,2-bis (4-hydroxyphenyl)-hexafluoropropane; 2,2-bis-(4-hydroxyphenyl) propane; bis-(4-hydroxyphenyl) cyclohexylmethane; 2,5-norbornanediol; phenolphthalein; bis-(4-hydroxyphenyl) oxindole; 1,4-bicyclo (2.2.2) octanedimethanol; 9,10-bis (B-hydroxyethyl) octahydroanthracane; trimethylol ethane; pentaerythritol; methyl diethanolamine; t-butyl diethanolamine;

decahydro-1,5-bis(hydroxymethyl) naphthalene; decahydro-1,8-bis(hydroxymethyl) naphthalate; decahydro-2,3-bis(hydroxymethyl) naphthalene.

Examples of suitable dicarboxylic acids which might be used in copolymers with poly(1,4-butylene terephthalate) are isophthalic acid; hexahydroterephthalic acid; homophthalic acid; para-carboxyphenoxyacetic para-carboxyphenylacetic acid; 8-(para-carboxyphenyl) octanoic acid; phenylenediacetic acid; chloroterephthalic acid; fluoroterephthalic acid; 2,5-dichloroterephthalic acid; 4-chloroisophthalic acid; 3,6-bis (carboxymethyl) durene; oxalic acid; adipic acid; sebacic acid; 1,4-naphthalenedicarboxylic acid; 1,5-naphthalenedicarboxylic acid; 2,6-naphthalenedicarboxylic acid; 2,7-naphthalenedicarboxylic acid; 4,4'-dicarboxybiphenyl; 3,3'dicarboxybiphenyl; bis-4(4-carboxyphenyl) butane; bis-(4-carboxyphenyl) octane; bis-(4-carboxyphenoxy) ethane; bis(4-carboxyphenoxy)hexane; bis-(4-carboxyphenylmethyl)ether; bis-(4-carboxyphenylmethyl ketene; bihenylenediacetic acid; biphenylenedibutyric acid; bis-(4-carboxyphenyl) ether; bis-(4-carboxyphenyl) sulfide; bis-(4-carboxyphenyl) sulfone; bis-(4-carboxyphenyl) ketone; 4,4'-dicarboxy-benzanilide; bis-(4-carboxyphenoxyethane); bis-(4-carboxythiophenoxy) ethane; ethyl bis-(4-carboxyphenyl) amine; 2,8-dibenzofurandicarboxylic acid; 1,4-bicyclo (2.2.2) octane dicarboxylic acid; cis and trans 4,4'stilbenedicarboxylic acid.

It should be ovious to one skilled in the art that hydroxy acids may also be usually employed, for example; 4-hydroxybenzoic acid; 3-chloro-5-hydroxybenzoic acid; 4-(2-hydroxyethyl) benezoic acid; poly(ethylene diphenoxyethane-4,4'-dicarboxylate) p-(ω-hydroxyalkyl-benzoic acid); aliphatic hydroxy acids or their lactones such as propiolactone and γ-hydrobutyric acid.

The poly(tetramethylene terephthalate) component of the hosiery yarns of this invention are believed to have repeating structural units of the formula

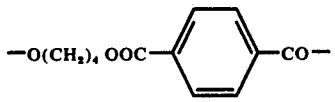

In the most preferred embodiment, the hosiery yarn of this invention essentially consists of poly(tetramethylene terephthalate), i.e., no other fiber-forming material is present therein.

Heterofilaments (or combination yarns) may be especially desirable where the combined properties of two or more polymeric yarn types are desired, for example, in a particular location of the hose. In such instances another hosiery yarn polymer such as a nylon, could be employed in heterofilament or (combination yarn structures) to contribute its advantages to the ultimate product.

The textured hosiery yarn of this invention most often has an initial modulus of from about 25 to about 50 grams per denier (as measured by ASTM test D-885-68, Section 11.10). It is believed that this relatively high initial modulus (as compared to the initial modulus of nylon hosiery yarn) is one of the factors which contributes to the favorable aesthetics of the textured hosiery yarn of this invention.

The textured hosiery yarn of this invention most often has an available torque ratio of from about 1 to about 6; the preferred available torque ratio is from about 1.25 to about 4.75. Available torque ratio is determined by a test wherein a sample of twist lively textured yarn is subjected to a tension of 250 milligrams per denier to "straighten" it out, and a 10 inch sample of the "straightened yarn" is taken. Thereafter the 10 inch sample of the "straightened"πyarn is supported and secured at both ends (these operations occurring when the sample is under said tension of 250 milligrams per denier), said tension of 250 milligrams per denier is removed from the yarn sample, and a weight of 25 milligrams per denier is attached to the lower end of the yarn sample to prevent the yarn from kinking upon itself when released. The lower end of the yarn is then released so that the yarn may twist, and the yarn sample is allowed to twist freely until it reaches equilibrium and stops; when no further twisting occurs in a period of 60 seconds, the sample is considered to have reached equlibrium. The number of turns made by the sample is counted and recorded as "initial twist". Both ends of the sample are then resecured, and the sample is exposed to saturated steam at atmospheric pressure for 5 minutes while under no tension. Thereafter, as before, a weight of 25 milligrams per denier is attached to the lower end of the yarn sample to prevent the yarn from kinking upon itself, the lower end of the yarn is then released so that the yarn may twist, and the yarn sample is allowed to twist freely until it reaches equilibrium; the number of turns made by the sample is counted and recorded as "developed twist".

$$\text{Available Torque Ratio} = \frac{\text{Developed Twist}}{\text{Initial Twist}}$$

The available torque ratio is a measure of existing and latent torsional forces introduced into the yarn by texturing. A ratio in excess of 3 tends to promote better knitability of the yarn, whereas a ratio less than 3 tends to minimize picking.

Where false twist texturing is employed, the textured hosiery yarn of this invention may be false twist textured by methods well known to the art such as, e.g., spindlett false twisting and friction false twisting. Thus, e.g., friction false twisting methods which use bushes or flanges wherein one or more friction surfaces in the same or different planes contact the yarn simultaneously or sequentially may be used to texture the yarn of this invention. Preferably during texturing said yarn is heat set at a temperature of from about 150° to about 230° centigrade for from about 0.05 to about 2.5 seconds, it being more preferred to heat set the yarn for from about 0.1 to about 2.0 seconds at a temperature of from about 175° to about 220° centigrade; the most preferred heat setting temperature is from about 190° to about 210° centigrade. The yarn should be textured to a twist level of from about 60 to about 200 turns per inch, although it is preferred to use a twist level of from about 100 to about 170 t.p.i. The yarn may be drawn (to a draw level of from about 2–5 and preferably from about 3 to 4) prior to or during the false twist texturing step.

The textured hosiery yarn of this invention most often has an elastic recovery of at least about 90 percent (as measured by ASTM Test D-1774-64). It is believed that this property contributes to the favorable aesthetics of hose made from the yarn.

The textured hosiery yarn of this invention is crimped, i.e., when the crimp is fully developed as by heating or steaming, e.g., said textured hosiery yarn has a percent developed crimp of at least about 12 percent. With multifilament yarn percent developed crimp is determined by measuring the length of a section of yarn under 3 m.g./denier tension, Lc, and measuring the length of the same section of yarn under just enough tension to remove all the crimp from the fibers, Lu. Over 18% developed crimp is preferred in the yarn of the invention and 22% is most preferred.

$$\text{Percent Developed Crimp} = \frac{LU - Lc}{Lu} \times 100$$

With monofilament yarn, percent developed crimp is determined by holding "S" and "Z" twisted (twisting used in the texturing operation) yarn side-by-side (ends clamped or held together but not piled) during the above-testing procedure.

It is preferred that the hosiery yarn of this invention have a torque of from about 1 to about 10 milligrams—centimeters. In the more preferred embodiments of this invention the torque of the yarn is from about 2 to about 8 milligram-centimeters, it being most preferred that the torque be from about 2 to about 5 milligram—centimeters. The torque of the yarn is measured by a modified Cahn Gram Electrobalance (Model G) which has clamped rigidly to the balance beam a nichrome wire bracket whose yarn hook rotates in the axis of the balance armature andd whose glass door is replaced by a stationary cardboard shield with a hold just large enough for the yarn hook and a removable glass plate in front of the zero assembly and weighting pan. When the yarn is tested with the modified balance, the balance is zeroed and calibrated in the milligram range, a one meter sample of the yarn is carefully removed from the bobbin without tension and without allowing any twist to escape, the sample is folded, the looped end is placed in the yarn hook, and the other end is fixed against rotation with tension just sufficient to prevent kinking. Samples with S twist turn the beam counter-clockwise, depressing the weighing pan; in this situation the beam is nulled, the force read in the normal fashion and recorded in milligrams, and this is converted to milligrams—centimeters by multiplying by 6.5 c.m. (the lever length or distance between the armature axis and the weighing pan). Samples with Z twist rotate the beam clockwise; thus samples of this nature are measured by placing the one milligram calibrating weight on the pan and allowing the torque of the yarn to subtract from the total.

It is preferred that the textured hosiery yarn of this invention have an elastic recovery of at least about 90 percent (as measured by ASTM Test D-1774-64). It is believed that this property contributes to favorable aesthetics of hose made from the preferred embodiments.

The textured hosiery yarn of this invention may be a monofilament or a multifilament, the latter being preferred. The denier per filament of the yarn is from about 2 to about 50. With multifilaments the preferred denier per filament is from about 2 to about 25, and the number of filaments can range from 2 to about 50 or more (preferably 2 to about 20 and most preferably 2 to about 7).

It is yet another object of this invention to provide a false twist textured poly(tetramethylene terephthalate) yarn with novel and advantageous properties. In accordance with this invention there is provided a textured yarn comprised of at least 50 percent (by weight of yarn) of poly(tetramethylene terephthalate) with a percent developed crimp of at least 12 and a denier of from about 10 to about 4000.

Stockings may be made from the textured hosiery yarn of this invention by techniques well known to the art. Thus, e.g., the yarns may be twisted to provide S and Z twist, heat set, and then twisted in the opposite direction to restore to zero twist and made into a stocking. Thus, e.g., the procedure of U.S. Pat. No. 2,089,239 and the like may be utilized. The stockings prepared from the textured hosiery yarn of this invention fit better and afford more comfort than do comprable nylon stockings. These stockings also characteristically have a high rate of recovery from low extension; thus they have less tendency to bag at the knees or wrinkle than nylon stockings. When the stockings of this invention have been extended 500 percent by a HATRA hose extender (4.5 pounds weight) and the force extending the stockings is removed, they preferably will recover at least 80 percent (and more preferably at least 85 percent) of their initial length within 15 seconds of the time the extension force is released. In the most preferred embodiment the stockings recover at least 90 percent of their initial length within 15 seconds of release.

The stockings of this invention are usually boarded at a temperature of from about 100° to about 150° centigrade for from about 15 seconds to about 5 minutes; it is preferred to subject the stockings to steam during the boarding process. The preferred boarding temperature is from about 110° to about 130° centigrade, and the most preferred boarding temperature is about 115° C. The preferred boarding time is from about 30 to about 60 seconds, with 45 seconds being the most preferred time. After the stocking has been subjected e.g., to steam at a temperature of from about 100° to about 150° centigrade for from about 15 seconds to about 5 minutes, it may be dried by subjecting it, e.g., to a temperature of from about 100° to about 150° centigrade for from about 0.5 to about 10 minutes.

In order to illustrate some of the preferred embodiments of this invention, the following examples (which are not to be deemed limitative of the invention) are presented below. Unless otherwise stated all parts are by weight and all temperatures are in degrees centigrade.

EXAMPLE 1

Poly(tetramethylene terephthalate) with an intrinsic viscosity of 0.80 which contained 0.45 weight percent of titanium dioxide delustrant was vacuum dried to a moisture level of about 0.02 percent. The dried polymer was then extruded at an extrusion temperature of aboout 260 degrees centigrade and a pack throughput of about 0.27 pounds per spinneret hole per hour, and the extruded fiber was wound up at a speed of 200 feet per minute. The extruded fiber was then drawtwisted at a speed of 2650 feet per minute to a total draw ratio of 3.47; the predraw ratio was 1.07, and the spindle throughput was 0.26 pounds/hour/spindle. A 21 denier 3 filament yarn (21/3) was prepared.

The yarn was then false twist textured at 180 feet per minute on a Leesona 553 using a heater temperature of 355° Fahrenheit, a twist level of 160 turns per inch, a spindle speed of 345,000 revolutions per minute, and an overfeed of about 6 percent. The tubes of textured yarns were then mounted on the Fletcher Winder and rewound (lirn build) onto producer pirns.

The yarn was then knit in plain jersey styles on Fidelity four feed machines which were equipped with vacuum takedown devices into pantyhose with the following characteristics:

| Knitted Cross Stretch and Link Count | |
|---|---|
| Panty — 15.5" | 41 Links |
| Boot — 14" | 64 + 50 Links |
| Ankle — 10" | 28 Links |

The pantyhose were then steamed for 30 minutes at 200° Fahrenheit, scoured, and dyed.

These pantyhose had superior latent crimp development, hand, stretch, and elastic recovery properties; they were much better than nylon pantyhose.

EXAMPLE 2

In substantial accordance with the procedure of Example 1, a pantyhose was prepared from a 21/3 poly(-tetramethylene terephthalate) yarn which was textured at a hot plate temperature of 385 degrees fahrenheit, a twist level of 160 turns per inch, and a windup overfeed of about 6 percent.

The bagging propensity and fit retention characteristics (these characteristics are the most important performance criteria which knitters and wearers use to rate stockings) of this yarn were measured by the "Instron Bagging Test". In this test and Instron apparatus with extension cycling capabilities, a "C" type compression cell, and a sample mounting stand, adapter, and plunger is used. The hosiery specimens used are circular (three inch diameter) portions of fabric; the swatches of fabric are cut from the thigh areas of the pantyhose. The test is conducted in the following manner:

1. Calibrate and zero Instron with the "C" cell in a compression cell mounting box. Then remove the cell from the mounting box and bolt into place on top of the Instron.
2. Move cross-head so that the plunger just touches the fabric (or, alternatively, use a piece of paper to establish the zero position). With the cross-head in this position. set the upper extension dial to 38.75 and the lower extension dial to 39.00. Set the selector to "extension cycle—simple".
3. Set 2 inch/minute chart speed and 10/inch minute cross-head speed. Use a 1 pound full scale load.
4. Clamp the fabric in the holder without stretching the sample.
5. Move the cross-head up by hand until the lower extension dial reads 0.00. Close the door over the hand positioning control and wait 1 minute (the chart moves 2 inches).
6. Set both cycle switches to cycle and allow to cycle 5 times.
7. As load increases on fifth cycle, turn both cycle switches off.
8. Hold at upper limit one minute.
9. Set upper cycle switch to cycle. Turn it off when the cross-head stops. Wait 1 minute.
10. Lower cross-head and remove the sample.

The hemispherical plunger in the Instron apparatus simulates a knee stretching the hosiery between 50 percent and 80 percent elongation (the longest arc of the expanded fabric sample is, respectively, 50 and 80% longer than the initial 3 inch diameter) in a cycle that duplicates actual wearer usage; during the cycle the Instron load cell measures the restoring force attempting to return the stretched hoseleg section to its rest state. The following readings which are taken off the Instron chart (and the wear analogy which each portion of the cycle simulates) are illustrated below:

| STEP | Load Cycle | Wear Analogy |
|---|---|---|
| A | 50% Elongation | *Hosiery fitted on straight leg. |
| B | Hold 1 minute at 50% Elongation | Hosiery relaxes on straight leg. |
| C | 80% Elongation | Hosiery on leg suddenly bent with extension from straight position. |
| D | 5 cycles between 50 and 80% Elongation | Hosiery on leg undergong flexing motion. |
| E | Hold one minute at 80% Elongation | Hosiery on leg with wearer in sitting position. |
| F | Return to 50% Elongation | Hosiery on leg suddenly relaxed to straightened position from expanded sitting position. |
| G | Hold 1 minute at 50% Elongation | Recovery from bagging on straight leg. |

*(It is estimated that about 50% expansion occurs around the knee when a previously unworn hose is fitted about the leg for the first time.)

When the pantyhose of this Example was tested by the Instron bagging test, it was found to exert the following forces at each of the steps of the test:

| Step | Force (grams) |
|---|---|
| A (50% Elongation) | 380 |
| B (Hold 1 minute at 50%) | 315 |
| C (80% Elongation) | 1122 |
| D (5 cycles between 50–80%) | — |
| E (Hold 1 minute at 80% | 693 |
| F (Return to 50% Elongation) | 48 |
| G (Hold 1 minute at 50%) | 100 |

The values most indicative of form retention are "A" and "G". The ratio A/G should be at least about ⅓ in order to ensure adequate recovery to the relaxed position without "bagging" and then "G" in an absolute sense should be large enough to enable the hose to retain the relaxed shape against normal flexing action.

EXAMPLE 3

The density of nylon is 1.14 g/.c., and the density of poly (tetramethylene terephthalate) is 1.32 g/c.c. Since it is denser, the diameter of a fiber made from the latter with the same denier as that of a fiber made from the former is smaller. 21 denier poly(tetramethylene terephthalate) yarn has approximately the same diameter as 18 denier nylon yarn (about 0.0047 c.m.). Thus the Instron bagging performance on nylon pantyhose made from 18 denier nylon yarn false twist textured at 410° Fahrenheit with a spindle overfeed of 2 percent was compared to the bagging performances of poly(tetramethylene terephthalate) pantyhose made from 21 denier yarn textured at 385° Fahrenheit with a spindle overfeed of 1 percent; the results of this comparison, inter alia, (and of comparisons with other pantyhose) are shown in Tables I and II.

TABLE I

STRETCH/RECOVERY PERFORMANCE OF POLY(TETRAMETHYLENE TEREPHTHALATE) AND NYLON HOSIERY YARNS ON INSTRON BAGGING TEST

Texturing Temp: Nylon - 410° - Poly(tetramethylene terephthalate) - 385° F
Overfeed to Spindle: All Poly(tetramethylene terephthalate) Yarns - +1%, Nylon 18/3 1%, Nylon 40/13 - +3%

| Panel Yarn | TPI | Stretching Force at 50% Elongation Initial | Stretching Force at 50% Elongation After 1 Min. | Stretching Force at 80% Elongation Initial | Stretching Force at 80% Elongation After 1 Min. | Recovery Force at 50% Elongation Initial | Recovery Force at 50% Elongation After 1 Min. |
|---|---|---|---|---|---|---|---|
| Poly(tetramethylene | 80 | — | — | — | — | — | — |
| terephthalate) | 100 | — | — | — | — | — | — |
| 21/3 | 120 | 256 | 196 | 703 | 544 | 40 | 77 |
| " | 140 | 344 | 273 | 996 | 606 | 45 | 94 |
| " | 160 | 380 | 315 | 1122 | 693 | 48 | 100 |
| Poly(tetramethylene | 80 | — | — | — | — | — | — |
| terephthalate) | 100 | — | — | — | — | — | — |
| 18/3 | 120 | 200 | 155 | 603 | 364 | 29 | 57 |
| " | 140 | 256 | 207 | 680 | 442 | 33 | 68 |
| " | 160 | 289 | 238 | 1092 | 645 | 35 | 74 |
| Nylon 18/3 | 80 | 152 | 93 | 493 | 219 | 5 | 30 |
| | 100 | 162 | 99 | 517 | 227 | 9 | 35 |
| | 120 | 166 | 103 | 440 | 210 | 12 | 37 |
| | 140 | 166 | 107 | 616 | 290 | 13 | 43 |
| | 160 | 175 | 114 | 575 | 255 | 14 | 45 |
| Poly(tetramethylene | 80 | 247 | 210 | 490 | 357 | 62 | 94 |
| terepthalate) | 100 | 426 | 355 | 911 | 536 | 62 | 118 |
| 50/13 | 120 | 507 | 404 | 957 | 603 | 73 | 143 |
| Nylon 40/13 | 80 | 79 | 57 | 219 | 116 | 11 | 25 |
| | 100 | 161 | 106 | 439 | 226 | 18 | 46 |
| | 120 | 200 | 154 | 541 | 291 | 22 | 63 |

TABLE II

STRETCH/RECOVERY PERFORMANCE OF 140 TPI POLY(TETRAMETHYLENE TEREPHTHALATE) YARNS VS. THROWSTER TEXTURED NYLON YARNS

| Yarn | Initial Force at 50% Elong. | Force After 1 min. at 50% Elong. | Initial Force at 80% Elong. | Force After 5 Cycles Between 50% & 80% Elong. | Force After 1 min. at 80% Elong. | Instant Recovery Force at 50% Elong. | Recovery Force After 1 min. at 50% Elong. |
|---|---|---|---|---|---|---|---|
| 140 TPI 18/3 F-Q | 266 gms. | 210 gms. | 845 gms. | 745 gms. | 489 gms. | 35 gms. | 64 gms. |
| 140 TPI 21/3 F-Q | 344 | 273 | 996 | 937 | 606 | 45 | 94 |
| Madison Throwing Co. 18/3 Nylon | 129 | 95 | 294 | 276 | 166 | 16 | 43 |
| Clingalon 21/3 Nylon | 97.5 | 79 | 385 | 358 | 200 | 12 | 36 |

Q - POLY(TETRAMETHYLENE TEREPHTHALATE)

It is seen that poly(tetramethylene terephthalate) has 2–3 times higher restoring forces than nylon at each step of the Instron cycle. On an equivalent denier basis, poly(tetramethylene terephthalate) has1-½-2 times higher restoring force than nylon 18/3. This means that poly(tetramethylene terephthalate) hosiery can be expected to cling more tightly to the leg without any visible evidence of bagging at the knee or ankle.

Poly(ethylene terephthalate) hosiery, knit from 160 tpi yarn, shows very high stretching forces and poor recover from strain in the Instron bagging test. This behavior is similar to that of false twist textured, nylon monofilament. Poly(ethylene terephthalate) hosiery would be expected to have poor fit retention and a high propensity to bagging at the knee or ankle. Such behavior has been observed in limited wear trials.

The stretch/recovery performance of 140 tpi poly(-tetramethylene terephthalate) panel yarns is compared to that for the best throwster textured nylon yarns in Table II. As before, poly(tetramethylene terephthalate) shows 1-½-3 times higher recovery forces than nylon, depending on whether equal yarn diameters are compared or equal deniers. Thus, poly (tetramethylene terephthalate) effectively combines excellent percent recovery with high actual recovery force value. Poly-(ethylene terephthalate) yarn has a reasonably high actual recovery force value, but low percent recovery. Nylon has a good percent recovery but low actual recovery force value. For best shape retention performance and reduced bagging, a good percent recovery should be coupled with sufficiently high actual recovery force value to maintain the "recovered shape on the leg".

EXAMPLE 4

A knit hose is prepared in substantial accordance with Example 1; the yarn of which the hose consists is false twist textured to a twist level of 110 turns per inch.

An 11.5 inch length of the knit hose is extended to 58 inches by a HATRA hose extender (4.5 pound weight), the extension force is released, and within 15 seconds of release of the extension force the hose is 13.5 inches long; thus within 15 seconds of release of the extension force the hose has recovered about 85 percent of its initial length.

EXAMPLE 5

In substantial accordance with the procedure of Example 1, a 20/3 friction false twisted yarn is produced from poly(tetramethylene terephthalate) with a relative viscosity of 19.4; during texturing the yarn is subjected to a temperature of 180 degrees centigrade for 0.18 seconds. The yarn has a linear shrinkage of 5.4 percent, an initial twist of 83 turns, a developed twist of 104 turns, and an available torque ratio of 1.25.

EXAMPLE 6

In substantial accordance with the procedure of Example 1, a 21/3 spindle false twisted yarn is produced from poly (tetramethylene terephthalate) with a relative viscosity of 19. During texturing the yarn is false-twisted to a level of 130 turns per inch and subjected to a temperature of 193° centigrade for 1.1 seconds. The yarn has a linear shrinkage of 4.9 percent, an initial twist of 74 turns, a developed twist of 350 turns, and an available torque ratio of 4.73.

Although the above examples and descriptions of this invention have been very specifically illustrated, many other modifications will suggest themselves to those skilled in the art upon a reading of this disclosure; these are intended to be comprehended within the scope of this invention. Nylon as used herein is inclusive of nylon 6, nylon 6,6 and copolymers and blends thereof.

We claim:

1. Pick resistant hosiery comprising twist lively yarn comprising at least 50% polyester, said polyester being essentially 100% poly(tetramethylene terephthalate), said yarn having an available torque ratio of 1 to 3, a sum of initial twist and developed twist less than 55 t.p.i., a percent developed crimp of at least about 12 percent, and from 1 to 50 filaments.

2. The hosiery of claim 1 wherein said yarn consists essentially of 100% poly(tetramethylene terephthalate) and has an elastic recovery of at least 90%.

3. The hosiery of claim 2 wherein said yarn has a percent developed crimp of at least 18 percent and a denier of at least 18.

4. The hosiery of claim 3 having at least 90% recovery when subjected to the HATRA extension test.

5. The hosiery of claim 2 having at least 90% recovery when subjected to the HATRA extension test.

6. The hosiery of claim 1 which comprises a combination yarn of melt-blended yarn containing nylon hosiery yarn polymer.

7. The hosiery of claim 1 wherein said yarn has a percent developed crimp of at least 22 percent.

8. The hosiery of claim 1 wherein said yarn has an initial modulus of about 25 to 40 g.p.d. per 100% elongation.

9. The hosiery of claim 1 wherein said poly(tetramethylene terephthalate) has a relative viscosity of from 11 to 75.

10. The hosiery of claim 1 wherein said yarn has a torque of 1 to 10 milligram centimeters.

11. The hosiery of claim 1 having at least 80% recovery within 15 seconds after being extended 500% by a HATRA hose extender under 4.5 pounds force.

* * * * *